United States Patent [19]

Olsen

[11] Patent Number: 4,763,483

[45] Date of Patent: Aug. 16, 1988

[54] CRYOPUMP AND METHOD OF STARTING THE CRYOPUMP

[75] Inventor: Donald A. Olsen, Millis, Mass.

[73] Assignee: Helix Technology Corporation, Waltham, Mass.

[21] Appl. No.: 887,369

[22] Filed: Jul. 17, 1986

[51] Int. Cl.[4] ..... B01D 8/00

[52] U.S. Cl. ..... 62/55.5; 62/100; 62/268; 62/383; 55/269; 248/638; 417/901

[58] Field of Search ..... 62/55.5, 100, 268, 383; 417/901; 55/269; 248/636, 638

[56] References Cited

U.S. PATENT DOCUMENTS

| | | | |
|---|---|---|---|
| 3,019,809 | 2/1962 | Ipsen et al. | 62/55.5 |
| 3,338,063 | 8/1967 | Hogan et al. | 62/55.5 |
| 3,512,369 | 5/1970 | Houyvet et al. | 62/55.5 |
| 3,585,807 | 6/1971 | Hengevoss et al. | 62/55.5 |
| 3,721,101 | 3/1973 | Sheppard et al. | 62/383 |
| 4,072,025 | 2/1978 | Thibault | 62/55.5 |
| 4,363,217 | 12/1982 | Venuti | 62/55.5 |
| 4,408,469 | 10/1983 | Forth | 62/55.5 |
| 4,438,632 | 3/1984 | Lessard et al. | 62/55.5 |
| 4,454,722 | 6/1984 | Bartlett et al. | 62/55.5 |
| 4,485,631 | 12/1984 | Winkler | 62/55.5 |
| 4,514,204 | 4/1985 | Bonney et al. | 62/55.5 |
| 4,541,249 | 9/1985 | Graves et al. | 62/55.5 |
| 4,577,465 | 3/1986 | Olsen et al. | 62/55.5 |
| 4,606,201 | 8/1986 | Longsworth | 62/55.5 |

FOREIGN PATENT DOCUMENTS 652804 12/1978 Switzerland .

*Primary Examiner*—Ronald C. Capossela

*Attorney, Agent, or Firm*—Hamilton, Brook, Smith & Reynolds

[57] ABSTRACT

The refrigerator of a cryopump is positioned within an insulating vacuum and the two stages of the refrigerator are selectively thermally coupled to first and second stage cryopanels. After initial rough pumping by an air ejector, rough pumping is completed during startup by coupling the cold first stage of the refrigerator to a first stage adsorption cryopanel. The second stage of the refrigerator is thereafter coupled to the second stage cryopanel. Thermal coupling of the refrigerator to the cryopanels is by means of spring biased thermal contacts brought into position by movement of the refrigerator. The thermal contact elements are provided with sufficiently large thermal masses to handle the large thermal loads of system startup.

27 Claims, 1 Drawing Sheet

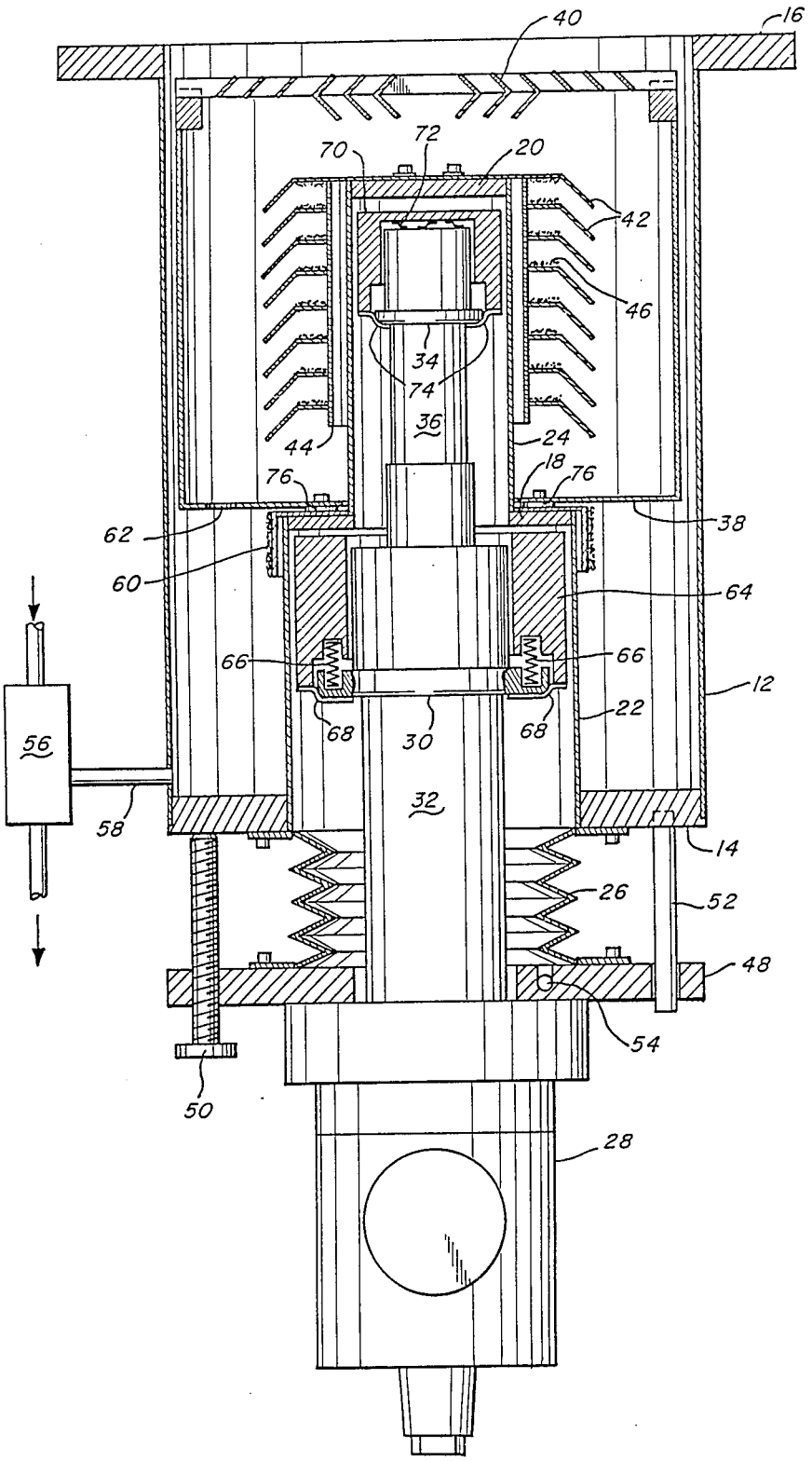
40
16
70
72
20
42
46
34
74
36
44
24
18
76
76
62
38
60
64
66
66
12
22
68
30
68
56
32
58
14
26
52
48
54
50
28

CRYOPUMP AND METHOD OF STARTING THE CRYOPUMP

DESCRIPTION

Background

In a typical cryopump a low temperature cryopanel array, usually operating in the range of 4 to 25 K., is the primary pumping surface. This surface is surrounded by a higher temperature radiation shield, usually operated in the temperature range of 70 to 130 K., which provides radiation shielding to the lower temperature array. The radiation shield generally comprises a housing which is closed except at a frontal cryopanel array positioned between the primary pumping surface and the chamber to be evacuated. This higher temperature, first stage frontal array serves as a pumping site for higher boiling point gases such as water vapor.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, only a vacuum remains in the work chamber. Typical vacuum pressures are below $5\times10^{-7}$ torr.

Once the high vacuum has been established, work pieces may be moved into and out of the work chamber through partially evacuated load locks. For the cryopump to be able to handle the load presented by the load lock, the load lock must first be reduced to a crossover pressure in the order of 10 torr. Higher loads cause the temperature of the cryogenic refrigerator to rise to a level from which the refrigerator can not recover on its own, and cryopump operation is destroyed. Partial evacuation of the load lock to crossover pressure has typically been by means of an oil lubricated piston roughing pump. However, the use of an air ejector, which does not present oil contamination, is suggested as a roughing pump in U.S. Pat. No. 4,577,465 granted on March 25, 1987.

With each opening of the work chamber to the load lock, additional gases enter the work chamber. Those gases are then condensed onto the cryopanels to again evacuate the chamber and provide the necessary low pressures for processing. After several days or weeks of use, the gases which have condensed onto the cryopanels and, in particular, the gases which are adsorbed begin to saturate the system. A regeneration procedure must then be followed to warm the cryopump and thus release the gases from the cryopanels and to remove the gases from the system. As the gases are released, the pressure in the cryopump increases and the gases are exhausted through a pressure relief valve.

After the gases have been released from the cryopanels and cryopump chamber, a vacuum is again created in the cryopump chamber. Before cooling the refrigerator and cryopanels to cryogenic temperatures, however, the cryopump must first be rough pumped to remove essentially all water vapor from the cryopump chamber and to reduce the pressure in the chamber to a level at which the cryopump may operate. Water vapor and other gases must be removed from the system to avoid contamination of the adsorbent on the second stage cryopanel. That adsorbent is best reserved for hydrogen and other gases which do not condense at the cryopump temperatures. Further, an intermediate vacuum pressure provides thermal insulation around the refrigerator which decreases the load on the refrigerator and allows it to reach cryogenic temperatures. Although an operating cryopump can face a crossover pressure of about 10 torr from a load lock and then reduce the pressure to the order of $10^{-6}$ torr, an initial pressure of less than 100 millitorr (100 microns) must be obtained for the refrigerator to be able to cool sufficiently to initiate cryopump operation. Air ejectors are not able to obtain the very low pressure required for cryopump startup, so an oil lubricated roughing pump or another operating cryopump has been required to complete the initial rough pumping for cryopump startup.

DISCLOSURE OF THE INVENTION

In accordance with the present invention, a cryopump is provided which, among other advantages, is effectively self-roughing during startup from pressures which are obtainable by an air ejector. A first stage cryopanel and a second stage cryopanel are positioned in a pumping volume. A closed cycle refrigerator having first and second stages is positioned in an insulating volume separate from the pumping volume. The insulating volume has a vacuum therein to thermally isolate the refrigerator from the first and second stage cryopanels and from the pumping volume. Thus, the refrigerator can operate at cryogenic temperatures within an insulating vacuum even though the cryopanels are warmed for regeneration. Means is provided for first thermally coupling the first stage of the refrigerator to the first stage cryopanel and thereafter coupling the second stage of the refrigerator to the second stage cryopanel. In this way, the first stage can complete rough pumping before the second stage cryopanel is cooled, and contamination of the second stage with gases which are condensable on the first stage is avoided.

Preferably, the first stage of the refrigerator is provided with a large thermal mass which can handle a large thermal load when the refrigerator is first coupled to the first stage cryopanel. In the preferred embodiment, that thermal mass cools a low thermal mass adsorption array which is positioned outside of the typical radiation shield. A thermal choke may be positioned between the adsorption array and the radiation shield so that the primary initial load on the first stage refrigerator is from the adsorption array and not the radiation shield.

The preferred means for providing the thermal switching which first connects the first stage of the refrigerator to the first stage cryopanel and then connects the second stage of the refrigerator to the second stage cryopanel includes means for axially shifting the cold finger of the refrigerator within the insulating volume. By spring loading a thermal mass away from the first stage of the refrigerator, the thermal mass can first be brought into thermal contact with the first stage cryopanel; as the refrigerator continues to be moved axially against the first stage spring force, the refrigerator second stage is moved into thermal contact with the second stage cryopanel. Spring loading of a thermal mass on the second stage of the refrigerator allows the first stage thermal mass to be brought into very close thermal contact with the first stage of the refrigerator in order that the first stage can handle higher loads during continued operation of the cryopump. A flexible thermal conductor can be provided to cool each thermal mass and to mechanically couple each thermal mass to the refrigerator.

BRIEF DESCRIPTION OF THE DRAWINGS

The foregoing and other objects, features, and advantages of the invention will be apparent from the following more particular description of a preferred embodiment of the invention, as illustrated in the accompanying drawing. The drawing is placed upon illustrating the principles of the invention.

The single figure is a cross sectional view of a cryopump embodying the present invention.

DESCRIPTION OF A PREFERRED EMBODIMENT

The cryopump shown includes the typical canlike vacuum vessel 12 closed at one end 14 and open at the opposite end. In use, the open end faces a like opening in a work chamber or, more likely, a valve which can isolate the cryopump from the work chamber. The cryopump is mounted to the valve or work chamber by a flange 16. Positioned within the vacuum vessel 12 are a first stage heat station 18 and a second stage heat station 20. In accordance with the present invention, the heat stations are supported on an insulating vessel formed of a larger diameter cylinder 22 and a reduced diameter cylinder 24. The heat stations and cylinders 22 and 24 are welded to each other to form a vacuum seal and the cylinder 22 is welded to the base 14. With a bellows 26, they form an insulating volume about the cold finger of a two stage cryogenic refrigerator. In this application, the refrigerator is a typical Gifford-MacMahon refrigerator driven by a motor 28. A heat station 30 is mounted to the cold end of the first stage 32 of the refrigerator and is held at a temperature in the range of about 70 K. to 120 K. A second stage heat station 34 is mounted to the second stage 36 of the refrigerator and is held by the refrigerator to a temperature in the range of about 8 K. to 20 K.

After startup, which will be described below, the cryopanel heat stations 18 and 20 are cooled by the refrigerator heat stations 30 and 34, respectively. As with conventional cryopumps, the heat station 18 cools a radiation shield 38 which is in the form of a can spaced from the vacuum vessel 12. A frontal array 40 spans the open end of the radiation shield 38. The second stage cryopanel is mounted to the second stage heat station 20 within the radiation shield 38. In this case, the cryopanel includes an array of baffles 42 which extend radially outward from an inverted cup 44. A charcoal adsorbent 46 is epoxied to each of the baffles.

After startup, the cryopump shown operates as a conventional cryopump. Gases which enter the pumping volume within the vacuum vessel 12 and which are condensible at the temperature of the frontal array 40 condense on that array. Other gases enter the volume within the radiation shield 38 and are condensed or adsorbed onto the second stage cryopanel. It is in startup of the refrigerator and the regeneration process, which includes a cryopump startup as the final step, that the operation of the present system differs significantly from conventional systems.

Once the cryopanels have condensed or adsorbed their maximum capacity of gases, the cryopump must be put through a regeneration process in which the cryopanels are warmed to room temperature to release the gases and in which the resultant large volume of gas is released from the system. In conventional systems, such regeneration is achieved by turning off the refrigerator and warming the entire system. In accordance with the present invention, however, the cryopanels are thermally decoupled from the refrigerator.

In the present system, the cryopanels are decoupled by axially shifting the cryogenic refrigerator downward as viewed in the figure to break thermal contact between the refrigerator heat stations 30 and 34 and the cryopanel heat stations 18 and 20. Thermal isolation is assured by the vacuum within the insulating volume. To that end, the refrigerator is mounted to a plate 48 suspended from the base 14 of the vacuum vessel. Axial movement of the refrigerator can be obtained by any suitable means including a pneumatic drive, but in the present system is shown to be simply by means of a lead screw 50. Additional guide posts 52 are positioned about .the circumference of the base 14. The bellows 26 allows for the axial movement of the refrigerator without destroying the vacuum within the insulating volume.

The vacuum within the insulating volume can be established at the factory through a pumping port 54 which is then sealed. Alternatively, a valve may be positioned at the end of the port to enable the system. user to create the vacuum or replenish the vacuum using a roughing pump. Because the insulating vacuum does not communicate with the pumping volume, it is not critical that the insulating volume be maintained free of oil contaminants. Therefore, a conventional oil lubricated piston roughing pump may be used to evacuate the insulating volume. The vacuum created by such a roughing pump is sufficiently low to enable the refrigerator to cool to cryogenic temperatures during initial startup of the system and the cooled refrigerator will then cryopump the insulating volume to a still lower pressure which is maintained as long as the refrigerator is operating.

During the regeneration procedure, the refrigerator continues to operate and maintain cryogenic temperatures at the heat stations 30 and 34. Because the large thermal mass of the refrigerator is removed from the portion of the system which must be warmed for regeneration, the warming time for regeneration is substantially reduced. Further, the time required to start the refrigerator is also eliminated from the regeneration process. As a result, a reduction in regeneration time of as much as 75 percent can be expected.

To restart the cryopump after regeneration, the pumping volume is first evacuated to about 5 to 10 torr by an air ejector 56 through a roughing conduit 58. Thereafter, the cryogenic refrigerator is displaced axially to thermally couple the first stage refrigerator heat station 30 with the cryopanel heat station 18 while the second stage remains decoupled. A first stage cryopanel 60 is mounted to the heat station 18 and preferably has an adsorbent such as charcoal epoxied thereon. With the cryopanel 60 cooled to a first stage cryogenic temperature of about 80 K., it is able to complete the rough pumping by condensing gases thereon. The cryopanel 60 is preferably of low thermal mass so that it can be promptly cooled. It is most conveniently positioned outside of the radiation shield 38 about the first stage of the refrigerator. To minimize flow restriction between the volume within the radiation shield 38 and the first stage cryopanel, roughing ports 62 may be provided in the shield.

During the period in which rough pumping is completed by the first stage of the cryopump, it is important that the vacuum within the pumping volume be reduced to about $10^{-3}$ torr without causing the temperature of the first stage of the refrigerator to exceed 120 K. If the temperature of the first stage exceeds 120 K., gases will again be released from the cryopanel, the load on the first stage will increase, and the ability to enter a full cryopumping mode of operation will be destroyed with a cascading increase in temperature of the refrigerator. In order that the first stage can handle the initial load and bring the pressure to a suitable level of less than $10^{-3}$ torr, the heat station 30 of the second stage is provided with a large thermal capacitance. In the system shown, that thermal capacitance is provided by a copper block 64 surrounding the heat station 30. The block 64 also serves as a thermal contact element. The thermal capacitance of the first stage must be sufficient to reduce the pumping volume from the pressure of the ejector pump to about $10^{-3}$ torr with a limited temperature increase from about 80 K. such that the first stage of the refrigerator never exceeds 120 K.

The block 64 is spring biased toward the cryopanel heat station 18 by means of a set of coil springs 66 spaced about the refrigerator heat station 30. The block 64 is also coupled to the heat station 30 by means of braided straps 68 formed of high thermal conductivity material such as copper. The straps reduce the conductance of the thermal path between the heat station 30 and the block 64. Also, where the cryopump is mounted in a position inverted relative to that shown in the figure, the strap prevents the block 64 from falling away from the heat station 30. The surface of the block 64 facing the cryopanel heat station 18 is coated with indium in order to minimize the thermal resistance between the block and the heat station 18 when the two are brought into contact.

Thus, as the refrigerator is moved upward as viewed in the figure, the indium coated upper surface of the cold block 64 moves into contact with the cryopanel heat station 18 and a low conductance contact is made between the two elements under the pressure of the springs 66. The springs and the braid 68 together form a thermal path which has a conductance less than that between the block and the heat station 18, but the thermal mass of the block is designed to be sufficient to handle the immediate load imposed by condensation of gases on the adsorption panel 60.

An additional thermal mass 70 serves as a second thermal contact element. It is positioned about the second stage heat station 34 and is spring biased from that heat station by a finger spring washer 72. The finger spring washer has six fingers, three of which are shown in the figure, spaced about its circumference and has been selected because of the high spring force which it exerts with a small displacement of those fingers. Thermal mass 70 is also thermally and mechanically coupled to the heat station 34 through high conductance braid straps 74. An indium coating on the thermal mass 70 provides for low conductivity contact.

When the block 64 first contacts the cryopanel heat station 18, the block 70 remains spaced from the second stage cryopanel heat station 20. With properly timed movement of the refrigerator, either incremental or continuous, the thermal mass 70 is brought into thermal contact with the cryopanel heat station 20 only after the first stage cryopanel has completed the rough pumping of the pumping volume.

The spring 72 allows the refrigerator to be moved further upward even after contact has been made at both stages. In that way, the spring 66 can be fully compressed into the hollow seats in the heat station 68 and the block 64 so that close thermal contact is made between those two elements to bypass the thermal path through the springs. By coating those contacting surfaces with indium, a low conductance path is provided between the heat station 30 and the block 64. During continued operation of the cryopump, the first stage of the refrigerator carries the higher load, and it is advantageous to minimize the thermal resistance to the first stage heat station 30. Total movement of the refrigerator is about ¼ inch.

Rough pumping by the cryopanel 60 is facilitated by the high conductance and low thermal mass of the cryopanel 60 so that it is rapidly cooled by the thermal mass 64. To minimize the instantaneous load seen by the first stage of the refrigerator when the cryopanel 60 is first thermally coupled to the refrigerator, a thermal choke is provided between the cryopanel heat station 18 and the radiation shield 38. That choke takes the form of washers 76 positioned between the radiation shield 38 and the cryopanel 18. Those washers are of relatively low conductivity. With that high resistance between the radiation shield 38 and the heat station 18, the radiation shield is isolated somewhat from the first stage of the refrigerator during the initial cooling of the cryopanel 60. The thermal choke offers the further advantage of preventing excessive cooling of the radiation shield below about 60 K., a situation which has been found to cause argon hangup during crossover.

It has been shown how positioning the cryogenic refrigerator within an insulating volume, and providing thermal switches which allow for the coupling of the first stage of the refrigerator to a first stage cryopanel prior to coupling of the second stage of the refrigerator to a second stage cryopanel, allows for startup and continued operation of a cryopump using only an ejector as a roughing pump for the pumping volume. Further, because the refrigerator need not be warmed for the regeneration process, the regeneration procedure is expedited significantly. The system has a further advantage of protecting the cold finger of the refrigerator, which houses high pressure helium gas, from any reactive process gases which may be pumped by the cryopump.

While the invention has been particularly shown and described with reference to a preferred embodiment thereof, it will be understood by those skilled in the art that various changes in form and details may be made therein without departing from the spirit and scope of the invention as defined by the appended claims.

I claim:

1. A method of starting a cryopump comprising:

providing a first stage cryopanel and a second stage cryopanel in a pumping volume, providing a close cycle refrigerator having a first stage and a second, colder stage in an insulating volume, and thermally isolating the refrigerator from the cryopanels and from the pumping volume by means of a vacuum in the insulating volume;

operating the refrigerator to cool it to cryopumping temperatures;

thereafter providing a thermal coupling between the refrigerator first stage and the first stage cryopanel to cool the first stage cryopanel and thereby condense gases thereon from the pumping volume; and thereafter providing a thermal coupling between the refrigerator second stage and the second stage cryopanel to cool the second stage cryopanel and thereby condense additional gases thereon from the pumping volume.

2. A method of as claimed in claim 1 further comprising reducing the pumping volume to a vacuum pressure by means of an air ejector prior to providing the thermal coupling between the refrigerator first stage and the first stage cryopanel.

3. A method as claimed in claim 1 further comprising providing a relatively large thermal mass cooled by the refrigerator first stage prior to thermal coupling with the first stage cryopanel and providing a first stage cryopanel of relatively low thermal mass.

4. A method as claimed in claim 1 wherein the first stage cryopanel comprises an adsorbent.

5. A method as claimed in claim 1 further comprising providing a radiation shield about the second stage cryopanel and cooling the radiation shield by means of the first stage of the refrigerator by means of a thermal choke between the first stage cryopanel and the radiation shield.

6. A method as claimed in claim 1 wherein the thermal coupling between the refrigerator and the cryopanels is by means of the step of moving the refrigerator within the insulating volume.

7. A method as claimed in claim 6 further comprising spring loading a thermal mass cooled by the first stage of the refrigerator toward a heat station in communication with the first stage cryopanel.

8. A method as claimed in claim 7 further comprising spring loading an element cooled by the refrigerator second stage toward a second stage cryopanel heat station.

9. A cryopump comprising:

a first stage cryopanel and second stage cryopanel in a pumping volume;

a refrigerator having a first stage and a second, colder stage in an insulating volume, the insulating volume having a vacuum therein to thermally isolate the refrigerator from the first and second stage cryopanels and from the pumping volume; and means for first thermally coupling the refrigerator first stage to the first stage cryopanel and thereafter coupling the refrigerator second stage to the second stage cryopanel.

10. A cryopump as claimed in claim 9 further comprising an air ejector for rough pumping the pumping volume.

11. A cryopump as claimed in claim 10 further comprising a large thermal mass cooled by the first stage of the refrigerator when the first stage of the refrigerator is isolated from the first stage cryopanel, the first stage cryopanel being of relatively low thermal mass.

12. A cryopump as claimed in claim 11 further comprising adsorbent material on the first stage cryopanel.

13. A cryopump as claimed in claim 11 further comprising a radiation shield surrounding the second stage cryopanel and a thermal choke between the first stage cryopanel and the radiation shield.

14. A cryopump as claimed in claim 9 further comprising a large thermal mass cooled by the first stage of the refrigerator when the first stage of the refrigerator is isolated from the first stage cryopanel, the first stage cryopanel being of relatively low thermal mass.

15. A cryopump as claimed in claim 14 further comprising adsorbent material on the first stage cryopanel.

16. A cryopump as claimed in claim 14 further comprising a radiation shield surrounding the second stage cryopanel and a thermal choke between the first stage cryopanel and the radiation shield.

17. A cryopump as claimed in claim 9 further comprising adsorbent material on the first stage cryopanel.

18. A cryopump as claimed in claim 9 further comprising a radiation shield surrounding the second stage cryopanel and a thermal choke between the first stage cryopanel and the radiation shield.

19. A cryopump as claimed in claim 9 wherein the means for thermally coupling the refrigerator comprises means for moving the refrigerator within the insulating volume.

20. A cryopump as claimed in claim 19 wherein a thermal contact element is spring biased relative to the first stage of the refrigerator.

21. A cryopump as claimed in claim 20 wherein the thermal contact element is of a relatively large thermal mass.

22. A cryopump as claimed in claim 21 further comprising a flexible thermal conductor coupling the thermal contact element with the second stage of the refrigerator.

23. A cryopump as claimed in claim 21 further comprising a thermal contact element spring biased relative to the second stage of the refrigerator.

24. A cryopump as claimed in claim 23 further comprising a flexible thermal conductor coupling the second stage thermal contact element with the second stage of the refrigerator.

25. A cryopump as claimed in claim 19 further comprising a bellows between the cryogenic refrigerator and the vacuum vessel forming the pumping volume, the bellows enclosing a portion of the insulating volume.

26. A cryopump comprising:

a first stage cryopanel and second stage cryopanel in a pumping volume;

a refrigerator having a first stage and a second, colder stage in an insulating volume, the insulating volume having a vacuum therein to thermally isolate the refrigerator from the first and second stage cryopanels and from the pumping volume; and means for moving the refrigerator relative to the first and second stage cryopanels to bring the refrigerator within the insulating volume into and out of thermal contact with the cryopanels.

27. A cryopump comprising a first stage adsorption cryopanel and a second stage cryopanel in a pumping volume;

an ejector for rough pumping the pumping volume;

a refrigerator having a first stage and a second, colder stage in an insulating volume, the insulating volume having a vacuum therein to thermally isolate the refrigerator from the first and second stage cryopanels and from the pumping volume;

a high thermal mass contact element in thermal contact with and spring biased relative to the first stage of the refrigerator; and means for moving the refrigerator within the vacuum vessel such that the first and second stages of the refrigerator can be moved into thermal contact with the first and second stage cryopanels with the first stage being coupled prior to the second stag being coupled.

* * * * *